US005898449A

United States Patent [19]

Narang et al.

[11] Patent Number: 5,898,449

[45] Date of Patent: Apr. 27, 1999

[54] INTERFACE SEAL BETWEEN PRINTHEAD AND INK SUPPLY CARTRIDGE

[75] Inventors: Ram S. Narang; William R. Burger, both of Fairport, N.Y.

[73] Assignee: Xerox Corporation, Stamford, Conn.

[21] Appl. No.: 08/169,081

[22] Filed: Dec. 20, 1993

[51] Int. Cl.[6] ..... B41J 2/175

[52] U.S. Cl. ..... 347/87

[58] Field of Search ..... 347/87, 13; 156/273.5; 428/462; 346/140 R

[56] References Cited

U.S. PATENT DOCUMENTS

| | | | |
|---|---|---|---|
| 4,678,529 | 7/1987 | Drake et al. | 156/234 |
| 4,771,295 | 9/1988 | Baker et al. | 347/87 |
| 4,774,530 | 9/1988 | Hawkins | 347/63 |
| 4,791,438 | 12/1988 | Hanson et al. | 347/87 |
| 4,864,329 | 9/1989 | Kneezel et al. | 347/93 |
| 5,233,369 | 8/1993 | Carlotta et al. | 347/87 |
| 5,289,212 | 2/1994 | Carlotta | 347/87 |

FOREIGN PATENT DOCUMENTS

| | | | |
|---|---|---|---|
| 5-008387 | 1/1993 | Japan | 347/87 |

OTHER PUBLICATIONS

Xerox Disclosure Journal, vol. 16, No. 4, Jul./Aug. 1991, p. 233.

*Primary Examiner*—N. Le

[57] ABSTRACT

An ink cartridge for an ink jet printer has an ink supply in a housing, a printhead fixedly attached thereto, and an interface seal between the housing and printhead. The ink is contained in an absorbent material in the housing which is partitioned from the printhead assembly by a housing wall having a vent and an ink outlet. The ink flow path from the housing outlet to the printhead inlet is produced by a recess in the outer surface of the housing wall covered by the interface seal. The seal is a porous member having a thermosetting adhesive layer on one side thereof. The porous member has a slot therethrough, and the adhesive is the type not attacked by the ink. The surface of the porous member with the adhesive is bonded to the housing wall. The thermosetting adhesive moves through the porous member and bonds to the printhead surface containing the ink inlet to the housing wall, when the adhesive is cured. The printhead ink inlet is of similar size and aligned with the porous member slot, so that the thermosetting adhesive assists in the attachment of the printhead assembly to the housing and concurrently provides the fluid seal between the housing and the printhead assembly.

7 Claims, 5 Drawing Sheets

INTERFACE SEAL BETWEEN PRINTHEAD AND INK SUPPLY CARTRIDGE

BACKGROUND OF THE INVENTION

This present invention relates to an ink supply cartridge for a thermal ink jet printer, and more particularly to an improved means for producing an ink flow passageway between the cartridge and printhead and concurrently providing a seal therebetween.

In existing thermal ink jet printing, the printhead comprises one or more ink filled channels, such as disclosed in U.S. Pat. No. 4,774,530, communicating with a relatively small ink supply chamber, or reservoir, at one end and having an opening at the opposite end, referred to as a nozzle. A thermal energy generator, usually a resistor, is located in each of the channels, a predetermined distance from the nozzles. The resistors are individually addressed with a current pulse to momentarily vaporize the ink and form a bubble which expels an ink droplet. The acceleration of the ink out of the nozzle while the bubble is growing provides the momentum and velocity of the droplet in a substantially straight line direction towards a recording medium, such as paper. Because the droplet of ink is emitted only when the resistor is actuated, this general type of thermal ink jet printing is known as "drop-on-demand" printing.

In current practical embodiments of drop-on-demand thermal ink jet printers, it has been found that the printers work most effectively when the pressure of the ink in the printhead nozzle is kept within a predetermined range of gauge pressures. Specifically, at those times during operation in which an individual nozzle or an entire printhead is not actively emitting a droplet of ink, it is important that a certain negative pressure, or "back pressure," exist in each of the nozzles and, by extension, within the ink supply manifold of the printhead. A discussion of desirable ranges for back pressure in thermal ink jet printing is given in the "Xerox Disclosure Journal," Vol. 16, No. 4, July/August 1991, p. 233. This back pressure is important for practical applications to prevent unintended leakage, or "weeping," of liquid ink out of the nozzles onto the copy surface. Such weeping will obviously have adverse results on copy quality, as liquid ink leaks out of the printhead uncontrollably.

A typical end-user product in this art is a cartridge in the form of a prepackaged, usually disposable, item comprising a sealed container holding a supply of ink and, operatively attached thereto, a printhead having a linear or matrix array of channels. Generally the cartridge may include terminals to interface with the electronic control of the printer; electronic parts in the cartridge itself are associated with the ink channels in the printhead, such as the resistors and any electronic temperature sensors, as well as digital means for converting incoming signals for imagewise operation of the heaters. In one common design of printer, the cartridge is held with the printhead against the sheet on which an image is to be rendered, and is then moved across the sheet periodically, in swaths, to form the image, much like a typewriter. Full-width linear arrays, in which the sheet is moved past a linear array of channels which extends across the full width of the sheet, are also known. Typically, cartridges are purchased as needed by the consumer and used either until the supply of ink is exhausted, or, equally if not more importantly, until the amount of ink in the cartridge becomes insufficient to maintain the back pressure of ink to the printhead within the useful range.

Other considerations are crucial for a practical ink supply as well. The back pressure, for instance, must be maintained at a usable level for as long as possible while there is still a supply of ink in an ink cartridge. Therefore, a cartridge must be so designed as to maintain the back pressure within the usable range for as large a proportion of the total range of ink levels in the cartridge as possible. Failure to maintain back pressure causes the ink remaining in the cartridge to leak out through the printhead or otherwise be wasted.

U.S. Pat. No. 5,233,369 discloses an ink-supply cartridge wherein two chambers are provided, the upper chamber having a capillary foam and the lower chamber substantially filled with ink. The printhead is disposed at a vertical height greater than the top level of the lower chamber. A second capillary foam, disposed along the supply line to the printhead, has a capillarity greater than that of the foam in the upper chamber. In another embodiment, only one chamber, corresponding to the lower chamber in the first embodiment and having no capillary foam therein, is provided.

U.S. Pat. No. 4,771,295 discloses an ink-supply cartridge construction having multiple ink storage compartments. Ink is stored in a medium of reticulated polyurethane foam of controlled porosity and capillarity. The medium empties into ink pipes, which are provided with wire mesh filters for filtering of air bubbles and solid particles from the ink. The foam is also compressed to reduce the pore size therein, thereby reducing the foam thickness while increasing its density; in this way, the capillary force of the foam may be increased.

U.S. Pat. No. 4,791,438 discloses an ink jet pen (ink supply) including a primary ink reservoir and a secondary ink reservoir, with a capillary member forming an ink flow path between them. This capillary member draws ink from the primary reservoir toward the secondary ink reservoir by capillary action as temperature and pressure within the primary reservoir increases. Conversely, when temperature and pressure in the housing decreases, the ink is drawn back toward the primary reservoir.

U.S. Ser. No. 08/151,625, filed Nov. 15, 1993, entitled "Ink Supply Cartridge For An Ink Jet Printer" by Dietl et al. and assigned the same assignee as the present invention, discloses the use of a thin layer of a film forming polymer, such as Mylar®, having a predetermined shape and a slot therethrough, with a thermosetting adhesive layer on both sides to form an ink passageway when positioned over an elongated recess in an external surface of an ink supplying cartridge. The cartridge outlet is connected to the recess, and the printhead is mounted against the film layer in such a manner that the printhead inlet is aligned with the slot in the film layer. The adhesive layer on one side of the film layer bonds the film layer to the cartridge and the adhesive layer on the other side bonds the printhead thereto and concurrently seals the film layer slot to the printhead inlet. Because the adhesive layers are exposed to the ink, the adhesive is a type that is not attacked by the ink.

SUMMARY OF THE INVENTION

In the present invention, a cartridge for supplying liquid ink to a thermal ink jet printing apparatus comprises a housing defining a single chamber having a wall with an outlet port therein. An absorbent medium occupies at least a portion of the chamber, the absorbent medium being adapted to retain a quantity of liquid ink. An ink passageway is formed when an elongated recess in the external surface of the housing wall is covered by a porous or mesh material having a predetermined geometry and a thermosetting adhesive layer on one side. A small slot in the shaped porous or mesh material serves as an outlet from the passageway and is aligned with and seals the printhead inlet. The porous or, mesh material is positioned on the cartridge wall over the elongated recess with the adhesive layer in contact with the cartridge wall. The porosity of the porous or mesh material allows the adhesive, during bonding and curing, to migrate from one side thereof through the pores of the porous or mesh material to the other side and bond the porous or mesh material against the printhead. This migration of the thermosetting adhesive through the porous or mesh material and subsequent curing thereof renders the porous or mesh material impervious to the ink and concurrently forms a seal around the printhead inlet.

BRIEF DESCRIPTION OF THE DRAWINGS

By way of example, an embodiment of the invention will be described with reference to the accompanying drawings, wherein like numerals indicate like parts, in which.

DESCRIPTION OF THE PREFERRED EMBODIMENT

Figure 1:
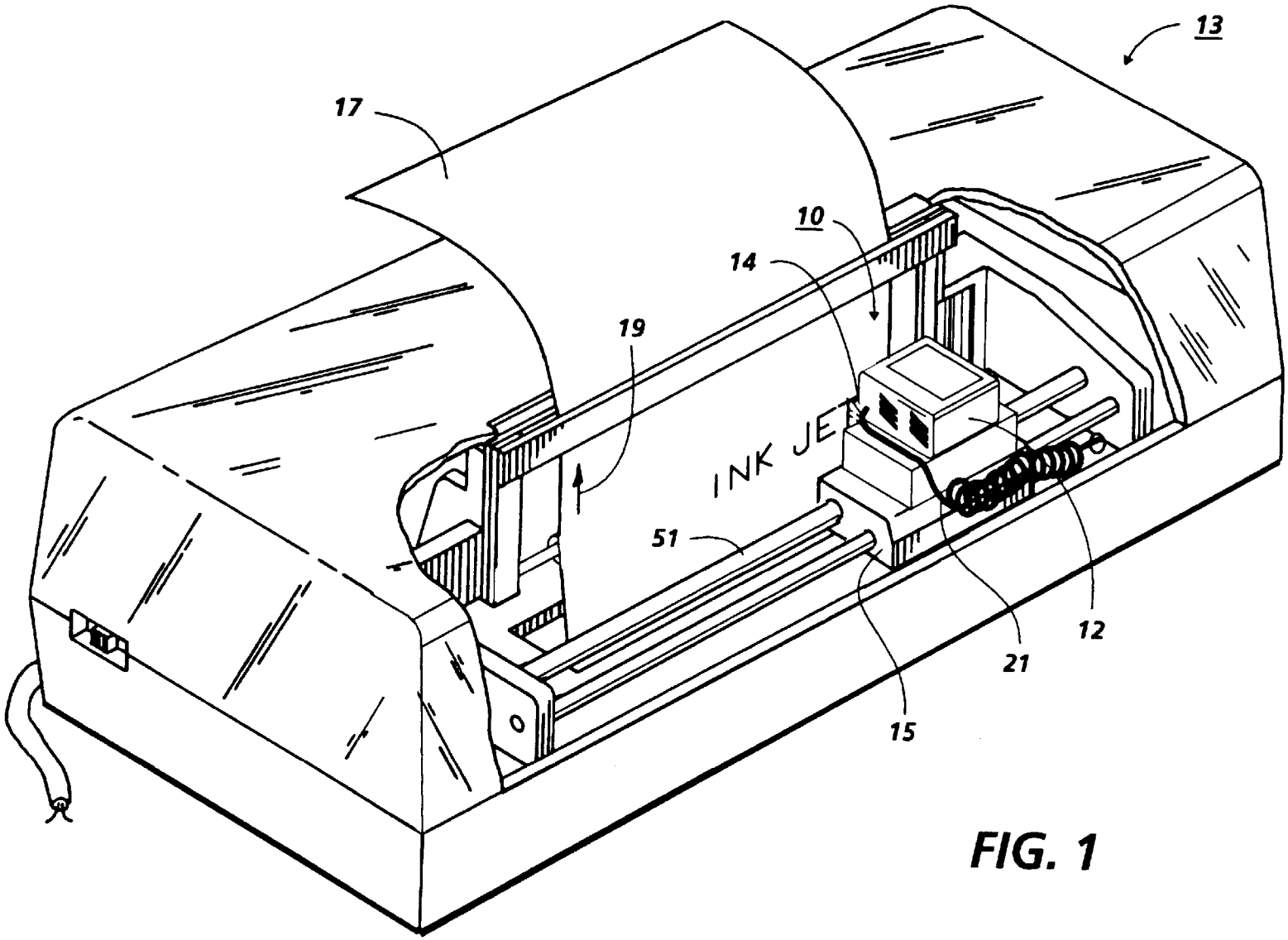
FIG. 1 is an isometric view of a thermal ink jet printer having the ink supply cartridge with the interface seal of the present invention.

FIG. 1 is a schematic, isometric view of a type of thermal ink jet printer 13 in which the printhead 14 and the ink supply therefor are combined in a single package, referred to hereinafter as cartridge 10. The main portion of cartridge 10 is the ink supply contained in housing 12, with another portion containing the actual printhead 14. In this embodiment of the invention, cartridge 10 is installed in a thermal ink jet printer 13 on a carriage 15 which is translated back and forth across a recording medium 17, such as, for example, a sheet of paper, on guide rails 51. During the translation of the printhead 14 by the carriage 15, the printhead moves relative to sheet 17 and prints characters on the sheet 17, somewhat in the manner of a typewriter. In the example illustrated, printhead 14 is of such a dimension that each translation of cartridge 10 along sheet 17 enables printhead to print with a swath defined by the height of the array of nozzles in printhead and the width of the sheet. After each swath is printed, sheet 17 is indexed (by means not shown) in the direction of the arrow 19, so that any number of passes of printhead 14 may be employed to generate text or images onto the sheet 17. Cartridge 10 also includes means, generally shown as cable 21, by which digital image data may be entered into the various heating elements (not shown) of printhead 14 to print out the desired image. This means 21 may include, for example, plug means which are incorporated in the cartridge 10 and which accept a bus or cable from the data processing portion (not shown) of the apparatus, and permit an operative connection therefrom to the heating elements in the printhead 14.

Figure 2:
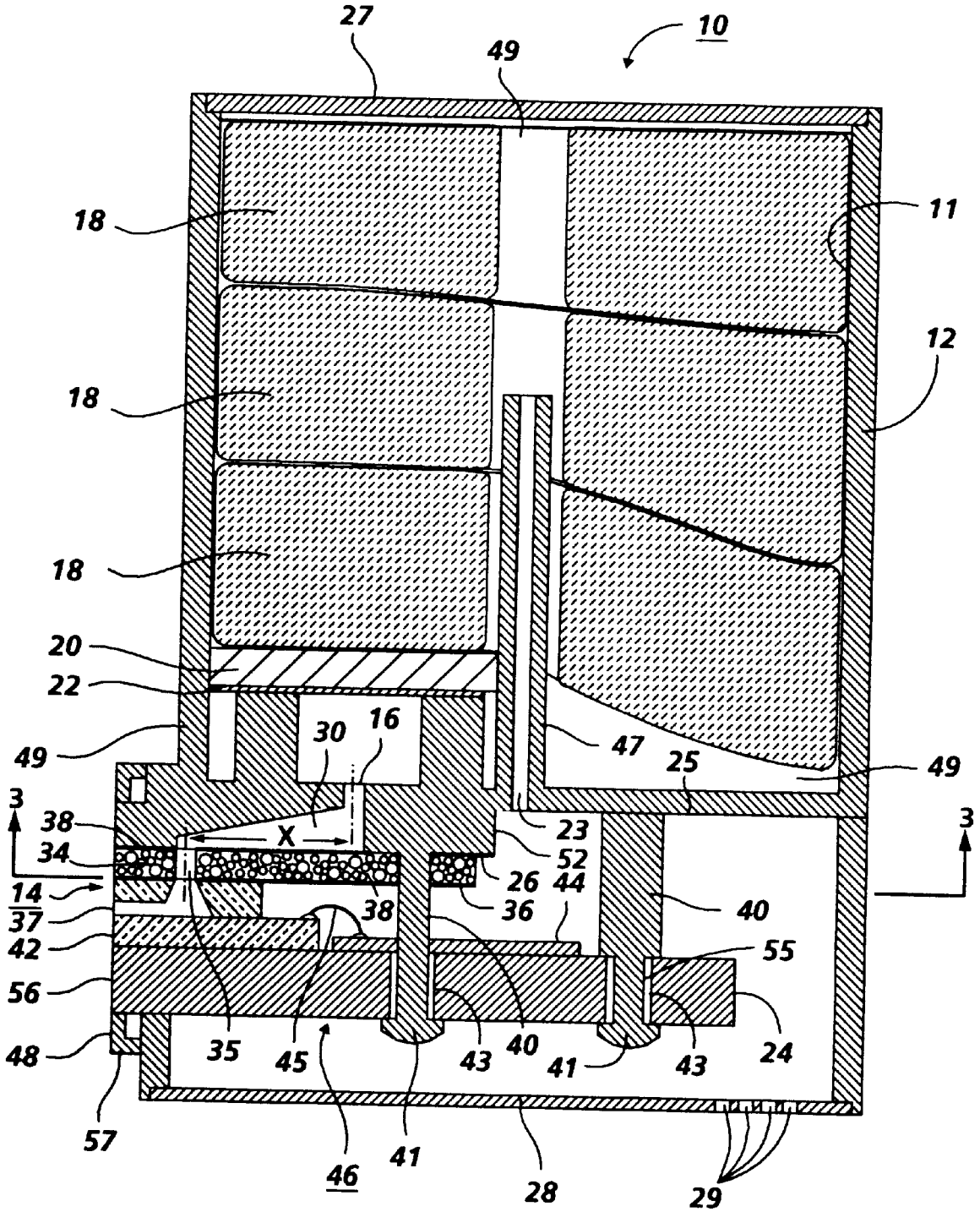
FIG. 2 is a schematic, cross-sectional elevation view of the cartridge in FIG. 1, showing the interface seal of the present invention.

FIG. 2 is a schematic sectional, elevational view of cartridge 10. The cartridge 10 has a main portion in the form of a housing 12. Housing 12 is typically made of a lightweight but durable plastic. Housing 12 defines an internal chamber 11 for the storage of liquid ink having a wall 25 with a ventilation port or vent 23, open to the atmosphere, and an output port or outlet 16. An elongated recess or trench 30 of varying depth is formed in the outer wall surface 26, which extends from the wall 25 to increase the wall thickness, thereby forming a step 52 on the housing wall 25. The recess 30 may be integrally molded in the chamber wall surface concurrently with the fabrication of the housing 12. One end of the elongated recess 30 is connected to the outlet 16 and the other end terminates at a location which will align with the inlet 34 of the printhead when it is attached to the chamber wall 25. The distance "X" from the center of the outlet 16 to the center of the printhead inlet 34 is about 10 mm. The offset distance x between chamber outlet 16 and printhead inlet 34 is necessitated because the nozzles 37 in printhead nozzle face 42 must be closely spaced from the recording medium by, for example, a distance of about 20 mils. This spacing is within the warping or cockling dimension of the recording medium, such as paper, which is the typical response to wet ink on the surface thereof. Thus, the printhead nozzle face must be projected beyond the cartridge housing 12, so that the housing cannot contact or drag on the recording medium position having the recently printed wet ink images thereon. When the printhead is mounted so that the nozzles are projected from the cartridge, the printhead inlet is positioned beyond the cartridge housing. The recess 30, which provides the ink passageway between the ink supply in chambers 11 and the printhead 14, must be sized to accommodate an appropriate rate of ink flow in order to prevent lack of timely refill of the printhead reservoir and/or pressure surges which cause the nozzles to weep ink. If the refill is too slow the printhead will malfunction. Accordingly, the ink flow inertance must be matched to the ink flow inertance of the printhead when it is printing. Inertance, is defined as the momentary pressures or pressure pulses generated by the acceleration of the fluid ink. In the preferred embodiment, the ink passageway between the printhead inlet 34 and ink supply chamber outlet 16 is geometrically shaped to have a cross-sectional flow area that increases from the printhead inlet to the chamber outlet. Though the preferred embodiment has only one recess 30, a plurality of recesses could be provided. In addition to maximizing the rate of flow of ink to the printhead and matching the ink flow inertance, the increasing cross-sectional area enables any air bubbles in the recess 30 to vent into the cartridge chamber, thereby keeping the passageway clear of flow impeding bubbles.

A relatively thin porous member 36, having a predetermined shape and a slot 35 therethrough, is placed on and subsequently bonded to the wall surface 26, covering the recess 30 in the outer or external surface 26 of the chamber wall 25. The slot 35 is substantially the same size as the printhead inlet. The porous member has opposing surfaces 31, 33, shown in FIG. 4, with the surface 31 of the film member 36 coated with any suitable thermosetting adhesive 38. The adhesive coating or layer 38 is in direct contact with the ink flowing through the passageway formed by the recess 30 and the porous member 36, so that the adhesive should be insoluble in components utilized in the ink. Typical preferred adhesives include combinations of phenolic resins and nitrile rubber available from Coating Sciences, Inc., but epoxy adhesives may also be used. Adhesives prepared from phenolic resins and synthetic rubber gives a strong adhesive with considerable flexibility and has good impact resistance at room temperature. The properties of the components vary with the requirements for mechanical strength, flexibility, adhesion to specific surfaces, and durability. Phenolic resins are any of several types of synthetic thermosetting resin obtained by the condensation of phenol or substituted phenols with aldehydes, such as, formaldehyde, acetaldehyde, and furfural. Such an adhesive is conformable, and will migrate through the porous member during the curing process, but the adhesive will not flow into the slot in the porous member or into the printhead inlet.

The porous member 36 is positioned against the bottom or outer surface 26 of the housing chamber wall 25 and the temperature raised to about 80° C. to cause the adhesive 38 on surface 31 to adhere or tack thereto without the adhesive moving completely through the porous member. The porous member is shaped to avoid the locating and fastening pins 40 integrally formed or molded with the housing and used to fixedly attach the printhead 14 and heat sink 24, as discussed later. The elongated recess 30 is hermetically sealed by the porous member and cured adhesive to form a closed ink passageway from the cartridge chamber 11 to the printhead nozzles 37.

Figure 7:
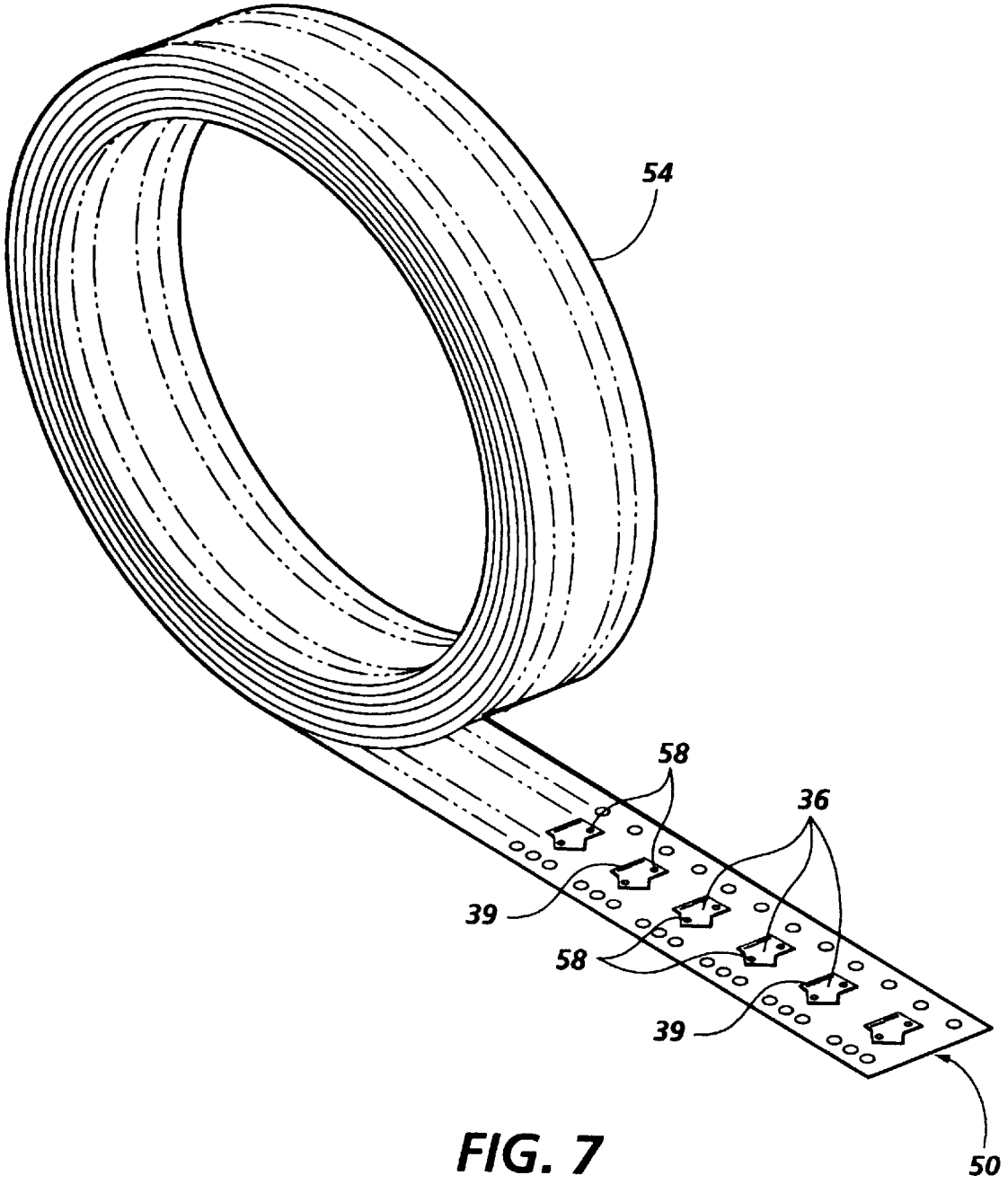
FIG. 7 is a schematic, isometric view of a roll of carrier strip containing a plurality of shaped film member releasably held thereon.

The porous member may be fabricated from any suitable porous material, such as paper or plastic material, by coating the desired adhesive on one side thereof. The porous member has a thickness of about 4 to 10 mils and preferably 7 mils. The coated porous material is then laminated to a 2 to 6 mils thick, preferably 3 mils thick, polyester release carrier strip 50 (see FIG. 7) on the side which has the adhesive layer 38. A progressive punching operation is used to first punch through the critical features of ink slot 35 and front edge 39 which is coplanar with the printhead nozzle face 42 and then the remaining profile or periphery of the porous member 36 is just scored to a depth of only 1 mil into the polyester release carrier strip 50. Only the porous members 36 are left on the carrier strip equally spaced therealong with the scrap material of 7 mil thick porous strip and adhesive layer thereon removed leaving a complete porous member 36 spaced every 1.5 inches down a 4,000 inch long polyester carrier strip 50 rolled on a spool or reel 54. The reel of porous members are fed into a pick and place zone of a robotic device (not shown) and the porous members 36 are vacuum picked off the carrier strip 50, positioned to the housing wall surface 26 using a vision system (not shown), and placed onto the housing wall surface 26 with a specified pressure of about 50 psi and temperature of about 80° C. This pressure and temperature tacks the porous member to the wall surface 26 without causing the adhesive to move completely through the porous member. The printhead 14 and bonded heat sink 24, as an assembly 46, is aligned and placed onto the awaiting porous member. The printhead 14 is bonded to the heat sink 24, so that the printhead inlet 34 is facing in a direction perpendicular to the heat sink. A printed circuit board 44 is also bonded to the heat sink adjacent the printhead. The terminals or contact pads (not shown) of the printhead 14 and circuit board 44 are interconnected by wire bonds 45. Locating holes 43 in the heat sink are used when mounting the printhead and heat sink assembly 46 to align the printhead inlet and nozzle face relative to the housing by inserting the housing stake pins 40 therein. The locating holes 43 are larger than that portion of the stack pins 40 residing therein, so that there is a space 55 therebetween which is filled with an appropriate adhesive (not shown), such as, for example, a UV curable adhesive and cured by exposure to UV light. The stake pin ends 41 are then ultrasonically staked to form pin heads 41 and the attachment of the printhead and heat sink assembly is complete.

The nozzle face 42 of the printhead 14 is coplanar with the edge 56 of the heat sink 24 and a portion of the upper edge of the housing chamber wall 25. This region of the cartridge 10 is covered by a rectangular shaped frame or face plate 48 having a lip 57 around the outer edge thereof and extending in a direction towards the housing. The void area between the frame and the housing is filled with a thermally curable passivation material (not shown) to form a hermetic seal completely around the printhead.The wire bonds 45 are encapsulated with the same thermally curable passivation material (not shown) as used around the face plate 48 by, for example, an injection syringe, which fills the cavity behind the printhead and covers the wire bonds. The housing 12 and attached printhead and heat sink assembly 46 is cured in an oven, thus simultaneously curing the thermosetting adhesive 38 and the wire bond encapsulating passivation material. The curing of the thermosetting adhesive 38 causes the adhesive to migrate or diffuse through the pores (not shown) of the porous member 36 and establish good contact with the printhead, thereby creating a direct bond between cartridge housing wall 25 and the printhead 14 and making the porous member solid and impervious to air and ink. Because of the good contact by the adhesive 38 on the printhead and around the printhead inlet 34, a hermetic seal is made between the cartridge outlet 16 and the printhead inlet 34. Cosmetic bottom cover 28 with ventilation openings 29 is positioned on the housing over the printhead and heat sink assembly 46 and ultrasonically welded to the housing.

The ink holding medium 18 is shown as three separate portions, occupying most of the chamber 11. The ink holding medium is saturated with ink and the top housing cover 27 of the same durable plastic material as the housing is placed on the housing and ultrasonically welded thereto. A tube 47 extends from the vent 23 to center of the interior of chamber 11 in the housing and through openings in each of the ink holding mediums. As is well known in the industry, the printheads will have on-board circuitry for selectively activating the heating elements (not shown) of the thermal ink jet printhead 14 as addressed by electrical signals for the printer controller (not shown) which connects to the cartridge printed circuit board 44 by the cable 21 (FIG. 1) when the cartridge is installed on the carriage 15.

Medium 18 is packed inside the chamber 11 of housing 12 in such a manner that the felt exerts reasonable contact and compression against the inner walls. In one commercially-practical embodiment of the invention, the medium 18 is created by stacking three layers of needled felt, each one-half inch in thickness, and packing them inside the housing 12.

Also within housing 12 is a member made of a material providing a high capillary pressure, indicated as scavenger 20. Scavenger 20 is a relatively small member which has a capillarity higher than that of medium 18 and serves as a porous capillary barrier between the medium 18 and the output port 16, which leads to the passageway formed by the recess 30 in the chamber wall 25 and the porous member 36. Scavenger 20 may be an acoustic melamine foam, one suitable type of which is made by Illbruck USA, Minneapolis, Minn., and sold under the trade name "Wiltec." The scavenger 20 preferably further includes a filter cloth, indicated as 22, which is attached to the melamine using a porous hot-melt laminating adhesive. In general, the preferred material for the filter cloth 22 is monofilament polyester screening fabric.

In FIG. 2, it can be seen that one portion of the outer surface of scavenger 20 abuts the ink holding medium 18, while other portions of the surface are exposed to open space 49 between the medium 18 and the inner walls of chamber 11. The single chamber 11 is so designed that a given quantity of ink may conceivably flow from the medium 18 to and through the scavenger 20, which has a higher capillarity than the medium 18, and through the filter 22, which has a higher capillarity than the scavenger, to the outlet 16 and through the passageway formed by the elongated recess 30 and porous member 36 to the printhead inlet 34.

Figure 3:
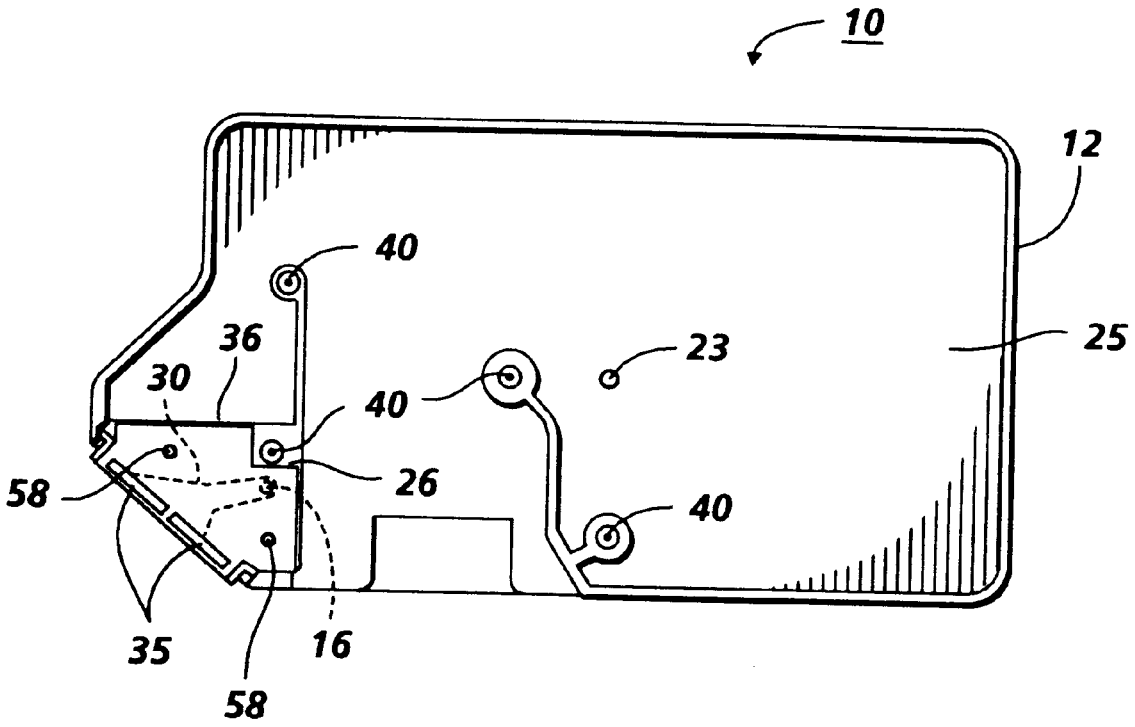
FIG. 3 is a cross-sectional plan view of the cartridge in FIG. 2 as viewed along line 3—3 therein.
Figure 4:
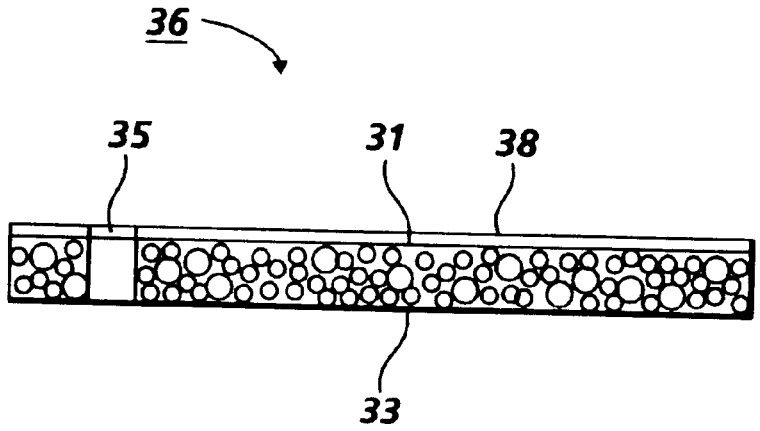
FIG. 4 is a cross-sectional view of the interface seal shown in FIG. 2, showing the adhesive on one side thereof prior to curing which causes migration of the adhesive therethrough.

FIG. 3 is a bottom view of the housing 12 as viewed along view-line 3—3, and shows the geometric shape of the porous member 36 required to fit the shape of the housing wall surface 26 in this region of the housing wall 25 and to avoid stake pins 40. The porous member is bonded to the surface 26 of housing wall 25 and covers the recess 30 and outlet 16 connected thereto, shown in dashed line. The passageway formed by the recess 30 and porous member 36 terminates at the through slot 35, which is similar in size and shape as the printhead inlet 34. Thus, the passageway transitions to the relatively thin slot. The thermosetting adhesive 38 on the porous member surface 31 (See FIG. 4) moves through the porous member to fill all of the pores therein and onto the opposite porous member surface 33, during the curing step, and surrounds the printhead inlet 34, so that the adhesive 38 and porous member provides the fluidic seal between the housing and the printhead. In addition to the slots 35 in the porous member 36, holes 58 are optionally stamped in the porous member for use by an end effector of a robot (not shown) to align the end effector therewith. The robot removes the porous member 36 from the carrier strip 50 of FIG. 7 and places it on the wall surface portion 26 of the housing 12. FIG. 4 is a cross-sectional view of the porous member and shows the porous member slots 35, surfaces 31, 33 with the thermosetting adhesive 38, preferably phenolic nitrile, only on surface 31.

As is evident in FIGS. 2–4, the ink must flow against the exposed thermosetting adhesive 38 on surface 31 of the film member 36. This adhesive should be insoluble in components utilized in the ink; otherwise, the ink would be contaminated by the adhesive and the adhesive eroded so that the ink may leak between the housing wall surface 26 and the porous member 36. Once the porous member 36 is positioned on surface 26 of housing wall 25, the adhesive 38 is heated to about 80° C. for about eight seconds at 50–90 psi to soften the adhesive. The softened adhesive conforms, wets all of the bonding surfaces of the housing wall, and moves partly through the porous member towards the other surface 33. The adhesive 38 is then allowed to cool to room temperature and return to its original consistency, thereby firmly tacking the porous member 36 to the housing wall surface 26. The softened and then cooled adhesive bonds the film member to the housing wall with enough strength to prevent relative movement therebetween when the printhead and heat sink assembly is assembled on the housing and against the porous member. Accordingly, the final curing process for the adhesive causes the adhesive to move through the porous member and coat the other surface 33 thereof, filling in all of the pores of the porous member. However, the adhesive is viscous enough to prevent flow into the slot 35 in the porous member or onto the nozzle face 42 of the printhead 14, either during or after assembly of the cartridge 10.

The thermosetting adhesive 38 is fully cured without pressure by heating the cartridge in an oven to a temperature of about 150° C. for about 60 minutes. This temperature is well within the temperature range of common plastic material such as that used for the cartridge housing 12, so that the curing of the thermosetting adhesive 38 will not affect the housing. The thermosetting adhesive 38, such as phenolic nitrile, thermosets into a flexible, medium hardness, rubber-like material having a hardness of about Shore A durometer of 55. The passivation material for the wire bonds and the sealing adhesive around the face plate or frame 48 which surrounds the printhead face and heat sink edges 56 are concurrently cured with the porous member adhesive 38.

Figure 5:
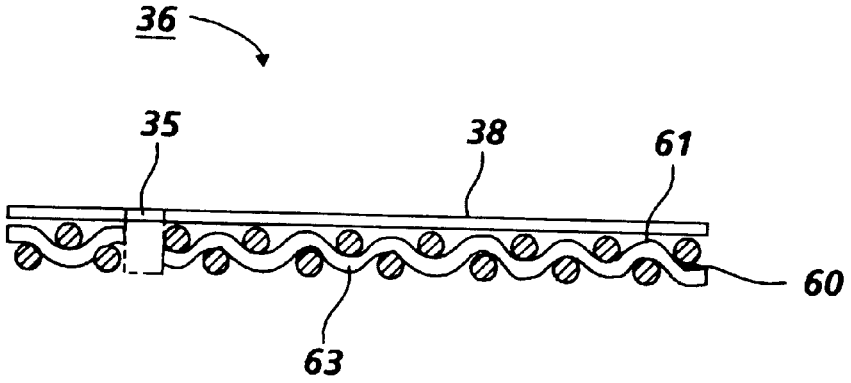
FIG. 5 is a cross-sectional view of an alternate embodiment of the interface seal shown in FIG. 4.
Figure 6:
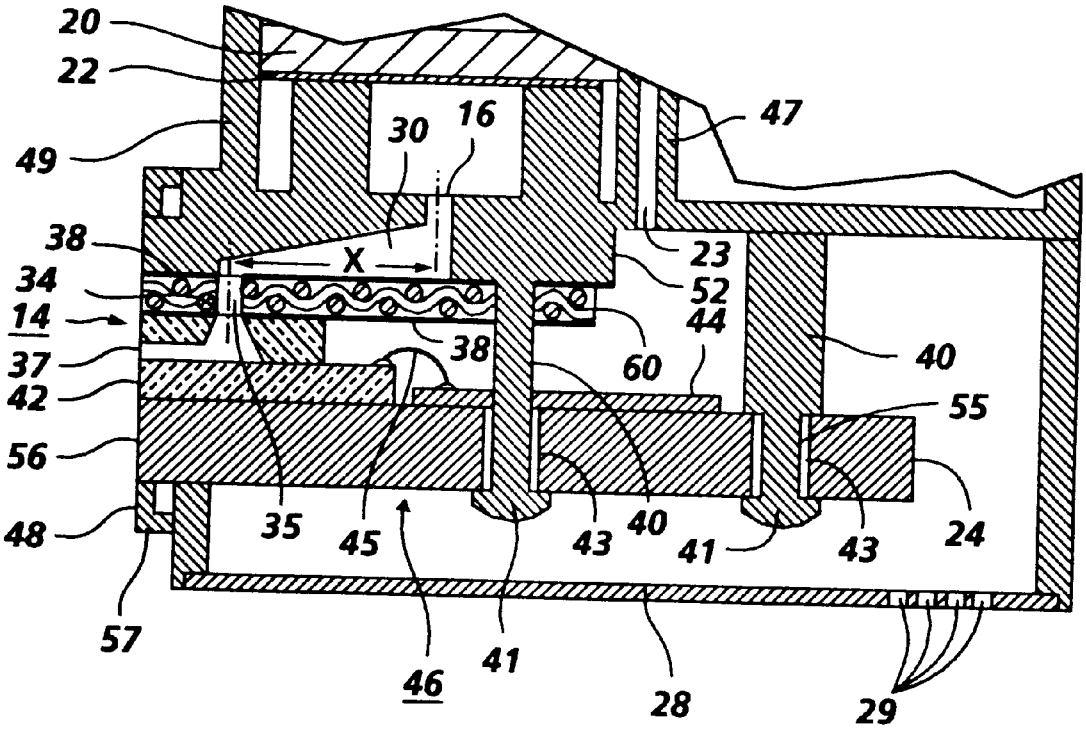
FIG. 6 is a partially shown, schematic, cross-sectional elevation view of the cartridge having the interface seal shown in FIG. 5.

An alternate embodiment is shown in FIGS. 5 and 6, wherein a layer 60 of plastic or metal mesh material is used instead of a porous material. Except for the substitution in the porous member 36 of the porous material for a mesh layer 60, the interface seal of the present invention and method of fabrication of the cartridge 10 is identical. In FIG. 5, a cross-sectional view of the porous member 36 has a thin mesh layer 60 having a thickness of 4–10 mils, preferably 7 mils, with opposing surfaces 61, 63. Prior to placing a strip of mesh layer on the carrier strip 50 in FIG. 7, the thermosetting adhesive layer 38 is deposited on surface 61 thereof. As with the porous material, the porous members with the mesh layer coated on one surface with the adhesive layer 38 is stamped or punched and the scrap material removed, leaving only the porous members of mesh material equally spaced therealong. The same procedure may be used to position the porous member with the mesh layer on the cartridge wall surface 26 with the adhesive layer 38 resting against the wall surface 26. FIG. 6, a partial side elevation, cross-sectional view of the cartridge, is similar to FIG. 2. FIG. 6 shows the porous member 36 with the mesh layer 60 after the adhesive layer 38 has been cured to cause the adhesive to move through the mesh material to fill all void areas therein and coat the opposite surface 63, thereby bonding the printhead 14 thereto, in the same manner as is done by the porous material in the porous member shown in FIG. 2.

Many modifications and variations are apparent from the foregoing description of the invention and all such modifications and variations are intended to be within the scope of the present invention.

We claim:

1. A liquid ink supply cartridge for an ink jet printer having an interface seal between the cartridge and a printhead fixedly attached thereto, the cartridge containing ink therein and the printhead having nozzles and an ink inlet, the cartridge comprising:

a housing having a chamber with liquid ink, the chamber having a vent and a wall, the wall having internal and external surfaces and an outlet therethrough;

a recess in the external surface of the chamber wall connected to the chamber outlet;

said interface seal being a flexible porous member having a predetermined thickness and shape and a slot therethrough at a predetermined location, the porous member having first and second surfaces with the first surface having a thermosetting adhesive layer thereon which is highly resistant to attack by the ink, the first surface of the porous member being aligned with and bonded to the external surface of the chamber wall, so that the recess and outlet are covered by the porous member to form a passageway from the outlet to the porous member slot; and said printhead being bonded to the second surface of the porous member with the porous member slot being aligned with the printhead inlet, so that curing of the adhesive causes the adhesive to move through the porous member, filling all pores or voids therein, and coating the porous member second surface, thereby providing a seal between the printhead inlet and the porous member slot and concurrently making the porous member impervious to air and ink and enabling direct bonding between the chamber wall and the printhead.

2. The cartridge of claim 1, wherein the porous member is paper having a thickness of 4 to 10 mils.

3. The cartridge of claim 1, wherein the porous member is a plastic material having a thickness of 4 to 10 mils.

4. The cartridge of claim 1, wherein the porous member is a mesh material having a thickness of 4 to 10 mils.

5. The cartridge of claim 1, wherein the adhesive on the first surface of the porous member is viscous enough when the adhesive is being cured, so that the adhesive moves through pores or voids in the porous member and fills the pores or voids and coats the second surface of the porous member, thereby enabling the printhead to be bonded directly to the chamber wall of the cartridge.

6. The cartridge of claim 5, wherein the adhesive softens and wets the chamber wall surface having the recess therein at a temperature of 80° C. for about eight seconds with a pressure of about 50–90 psi; and wherein the adhesive tacks the porous member to the chamber wall when the adhesive cools to room temperature to prevent movement of the porous member relative to the external wall surface of the housing when the printhead is aligned with and mounted on the cartridge.

7. In an improved thermal ink jet printer which includes a cartridge having a supply of ink therein, said cartridge being in ink flow communication with nozzles of a printhead the improvement comprises an interface between the printhead and the cartridge which is sealed by a flexible porous member having a slot therethrough and having first and second surfaces coated with a thermal setting adhesive which fills all pores of said member, the porous member being impervious to air and ink the porous member further providing a direct bonding between the cartridge and printhead.

* * * * *